US005313803A

United States Patent [19]

Detzer

[11] Patent Number: 5,313,803

[45] Date of Patent: May 24, 1994

[54] AIR CONDITIONING SYSTEM FOR HUMAN-OCCUPIED SPACES

[75] Inventor: Rüdiger Detzer, Büseck, Fed. Rep. of Germany

[73] Assignee: Kesslertech GmbH, Giessen, Fed. Rep. of Germany

[21] Appl. No.: 940,922

[22] Filed: Sep. 8, 1992

[30] Foreign Application Priority Data

Sep. 14, 1991 [DE] Fed. Rep. of Germany ..... 4130648
Sep. 14, 1991 [DE] Fed. Rep. of Germany ..... 4130650
Sep. 14, 1991 [DE] Fed. Rep. of Germany ..... 4130651

[51] Int. Cl.[5] ..... F25D 17/06; F24F 3/16; B01D 46/24

[52] U.S. Cl. ..... 62/89; 62/78; 62/418; 62/426; 62/93; 62/94; 181/224; 181/225; 181/258

[58] Field of Search ..... 62/89, 91, 92, 93, 94, 62/296, 78, 418, 426; 181/224, 225, 258

[56] References Cited

U.S. PATENT DOCUMENTS

| | | | |
|---|---|---|---|
| 1,058,491 | 4/1913 | Swanton | 181/258 X |
| 2,299,112 | 10/1942 | Schilling | 181/224 |
| 2,902,834 | 9/1959 | Bosworth, Jr. et al. | 62/78 |
| 2,989,855 | 6/1961 | Thompson | 62/296 |
| 3,059,564 | 10/1962 | Curran et al. | 181/224 X |
| 3,593,499 | 7/1971 | Herbert | 181/225 |
| 3,728,866 | 4/1973 | Layton | 62/78 X |
| 3,748,997 | 7/1973 | Dean, Jr. et al. | 62/296 X |
| 4,266,602 | 5/1981 | White et al. | 181/224 |
| 4,316,522 | 2/1982 | Hirschorn | 181/224 |
| 4,845,958 | 7/1989 | Senda et al. | 62/94 X |
| 4,857,090 | 8/1989 | Hartness | 62/91 |
| 4,877,106 | 10/1989 | Neville et al. | 181/224 |
| 4,956,978 | 9/1990 | Bleck et al. | 62/296 X |
| 5,030,423 | 7/1991 | Obee et al. | 62/78 X |
| 5,085,266 | 2/1992 | Arold et al. | 62/78 X |

FOREIGN PATENT DOCUMENTS 0357917 3/1990 European Pat. Off. .

OTHER PUBLICATIONS

Recknagel/Sprenger/Hönmann "Taschenbuch für Heizung und Klimatechnik", R. Oldenburg Verlag München und Wien, 1987, p. 900, FIG. 329-2).

*Primary Examiner*—Henry A. Bennett
*Assistant Examiner*—C. Kilner
*Attorney, Agent, or Firm*—Herbert Dubno; Yuri Kateshov

[57] ABSTRACT

A central air conditioning unit with a blower and feed duct is provided with a filter unit between the blower and the air outlet into the space applied with the conditioned air. The filter unit has both a sorption filter and a suspended filter and is constructed and arranged to form a sound barrier, i.e. a sound-damping or sound-blocking system.

20 Claims, 11 Drawing Sheets

AIR CONDITIONING SYSTEM FOR HUMAN-OCCUPIED SPACES

FIELD OF THE INVENTION

My present invention relates to an air conditioning system for human-occupied spaces, especially for residences, workplaces and the like with a central air conditioning unit for conditioning the air, blower means for displacing the conditioned air located in the region of the central unit, at least one duct for the treated air and at least one outlet duct with an air discharge unit for introducing the room air into a space to be air conditioned.

BACKGROUND OF THE INVENTION

Air conditioning units of the aforedescribed type are referred to as room air conditioners. The reference to human applications of such air conditioning units is intended to indicate that the air conditioner is primarily for rooms occupied by people including offices, domiciles, theaters, commercial establishments, hospitals, schools and other institutions.

The reference to air conditioning is here intended to cover complete conditioning systems as well as partial conditioning systems. Complete conditioning systems are those which can effect all four thermodynamic air treatment functions, namely, heating, cooling, moisturization or humidification and dehumidification to appropriate levels or with appropriate controls. Such units thus contain control devices for all four of the thermodynamic conditions.

Partial conditioning systems are those which provide reduced functions, for example, only cooling. The control systems are correspondingly reduced in such arrangements.

Conditioning systems of the described type and for the described purposes are well known for domiciles. Their construction and configurations have been designed to satisfy air conditioning technology requirements for such domiciles. Nevertheless they can be improved upon.

In the past, for example, conditioned room air was not completely free from suspended matter and molecular impurities that could collectively be referred to as contaminants. The reference to suspended matter is intended to cover both inorganic and organic particulates, including viruses, bacteria, fungi or molds. In addition, the blower generated considerable noise, usually in a frequency range of 125 to 250 Hz. The sound level at the outlet of the blower increased with blower power and decreased along the duct to the air outlet. Nonetheless there was a high sound level at the outlet of the blower with a high sound level in the space to which the treated air was admitted.

With conventional air conditioning systems of the type over which the present invention is an improvement (see, for example, Recknagel, Sprenger, Hömann "Taschenbuch der Heizungs- und Klimatechnik", R. Oldenburg Verlag München und Wien 1987, Pg, 900, FIG. 329-2), it is known to equip a central air conditioning unit with a filter device. This is provided upstream of the units which effect the conditioning of the air and filters the fresh air entering the central unit and/or the recirculated air delivered thereto. To reduce the noise below a detrimental level and to suppress noise generally, it is known to form the feed duct of the treated room air so that it is of a sound-damping nature and/or to combine this duct with sound-damping features (see Recknagel, Sprenger, Hönmann, loc. cit. pg. 1073 to 1076).

It is also known, in this connection, to provide sound-blocking structures for such systems. Sound-blocking refers to the interference with the spreading or transmission of sound by interposing sound reflecting barriers or materials. A measurement for the degree of sound blocking is the sound blocking coefficient or the degree of sound transmission (ratio of transmitted sound to generated sound). In order to generate a maximum possible sound reflection, a medium must be provided in the sound path whose sound damping impedence differs from that of the sound transmission medium, i.e. the treated room air, to the greatest possible extent. For example, a high density, high weight solid mass can serve as an effective sound blocking medium as interposed along a sound path because of its much greater sound block impedence than the impedence of the propagation medium, namely, room air.

For air transmitted sound, therefore, sound blocking requires hard and heavy materials in the form of walls for high sound frequencies while for lower frequencies the use of walls of relatively soft bendable materials or body vibration materials are used.

For sound-damping, i.e. the reduction of sound transmission or the attenuation of sound, sound absorbing media or devices are used. A measure of sound damping is the degree of sound adsorption, i.e. the proportion of the sound impinging upon a surface which is transmitted through it. Sound-damping is a characteristic of materials which are particularly suitable for blocking sound transmission and in general some of these materials will also give rise to a noticeable sound-damping. Sound-damping materials seldom block all sound, although they will give rise to a significant attenuation, i.e. should have a sound adsorption of at least 10% and usually much more. Sound-damping materials are usually materials which convert sound to thermal energy by internal friction. The field is aware of many sound-damping and sound-blocking materials and the conditions under which both may be used or provided to achieve either sound-damping or sound-attenuation or both.

With the previously described known air conditioning systems, providing filter units upstream of the central unit, even with said ducts which have sound-damping or sound-blocking devices associated therewith, the filter unit and the sound-damping or sound-blocking unit operate individually and additively as far as energy losses are concerned. As a consequence, the blower capacity must be increased and this results in ah increased noise level at the blower outlet.

OBJECTS OF THE INVENTION

It is, therefore, the principal object of the present invention to provide an improved air conditioning unit or system whereby these drawbacks are avoided.

A more specific object of the invention is to provide an air conditioning system in which the cleaning and treatment of the room air can be more efficient while the emission of noise can be substantially reduced, especially with respect to the noise delivered to the room to be air conditioned.

Another object of this invention is to provide a reduced noise air conditioner which operates at lower energy cost and with improved efficiency.

SUMMARY OF THE INVENTION

These objects and others which will become more readily apparent hereinafter are attained, in accordance with the invention, in an air conditioning system for spaces occupied by people, especially domiciles, workplaces and institutions, wherein a central unit for treating the air is provided with a blower for displacing the treated air, at least one feed duct extending from the blower to the space to be air conditioned and a discharge device supplied by this duct at this space for delivering the treated air through an outlet passage into the room.

According to the invention, between the blower and the outlet, I provided a filter device for the treated room air which is transversed thereby and comprises at least one suspended-material filter and at least one sorption filter and wherein, further, the filter device forms a sound-damping and/or sound-blocking device with the filter elements forming sound-damping or sound-blocking elements.

The reference to a suspended material filter is intended to include sieves, screens and other structures for mechanically trapping and removing particulates.

The reference to a sorption filter is intended to refer to a filter which operates by adsorption and/or absorption and especially by chemisorption in which chemical reactions with contaminants remove them from the room air stream.

With the system of the invention, the filter device, consisting of at least one suspended-material filter and at least one sorption filter also fulfills a further function, namely, a sound-damping and/or sound-blocking function. While all known suspended-material and sorption filters will provide sound-damping and sound-blocking effects to a limited degree, the degree of sound-damping and sound-blocking can be greatly enhanced in accordance with the invention if the suspended-material filter and/or the sorption filter are provided as perforated plates or grid plates of relatively massive materials which can have a sound-blocking effect and where the positioning of these materials allows them to intercept high and low frequency sounds and to provide the sound-damping and blocking principals developed above.

In other words where high frequency sounds are primarily the problem, the suspended material and sorption filter combination can be made more massive and positioned to intercept the sound passing with the room air along the duct whereas other portions of this filter or the entire filter can be provided to be somewhat yieldable and capable of converting sound energy into friction energy for the blocking or attenuation of lower frequency sounds. Depending upon the weighting of the high and low frequencies of the sound produced by the blower, which is experimentally determined relatively easily, the filter construction can be varied.

Of course, the filter surface and throughput should be such that the filters provide effective gas cleaning and removal of contaminants for long operating times.

In a preferred embodiment of the invention, the filters of the filter units form baffling or deflection devices for the treated room air so that the filters are formed as filter walls between which flow passages are formed. The room air can be deflected from the original direction of flow along these flow paths and sound-damping and sound-blockage can be effected by inducing the flow through the filter in such manner that a relatively low flow velocity of the treated room air within the filter is followed by an acceleration of the flow in the passages and a number of deflections are provided so that a minimum of sound propagation through the filter can occur.

Preferably, the filter walls are double layered and include a suspended-material layer and a sorption layer.

I have found that the filter effect and the sound-damping and sound-blocking effect can be optimized when the filter unit provides a minimum pressure drop of 50 Pascal.

The filter unit can be formed with plate filters which define flow passages between then and are oriented perpendicular to the general flow direction. They can also be formed with cylindrical filter walls and central flow passages as filter cartridges. An embodiment can also be used as described in EP-OS 0 357 917 which has been found to be particularly effected for sound-damping and sound-blocking According to the invention, the filter cartridges form a sound-damping lattice or grid with the elements of the grid being filter cartridges each of which is double walled and composed of a sorption filter and a suspended material filter. The spacing between the grid elements should be, according to the invention, smaller than the principal wave-length of the noise which is transmitted.

With this construction, a combination of speed reduction, speed increase and repeated deflection of the flow of the treated air can provide a significant sound-damping or sound-blocking, especially if the filter elements themselves are relatively massive and hard in part and in part are relatively soft and sound absorptive by reason of the conversion of the acoustic energy to friction energy. Indeed, since sorption filters have a relatively high mass by comparison to the mass of suspended material filters, the two layer filters provide both the high mass and the yieldability which has been found to be desirable. Sorption filters in general are characterized by a carrier for the adsorbent or adsorbent which is retained in open pores of the carrier. The absorption or adsorption medium can be relatively massive while the open pore structure can be composed of a foam which is particularly suitable for converting acoustic energy to friction energy.

Since the filters should be changed from time to time if they become contaminated, the filter plates can be formed as cassette plates which are replaceably mounted cassette guides while the filter cartridges can be replaceable in filter cartridge sockets.

The invention also includes a method of operating an air conditioning unit wherein the central unit generates in the region ahead of the filter device a predetermined static pressure p and the sound-damping and/or sound-blocking device formed by the filter unit is designed to provide a pressure drop of at least 50% and at most 80% of the predetermined static pressure p. Preferably the air is supplied through the filter unit with a pressure drop of at least 60% of the predetermined static pressure. Furthermore, it has been found to be advantageous to provide the air outlet units so that they transform the flow of the treated air downstream of the filter into a vortex flow and most advantageously into a high turbulent vortex flow.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
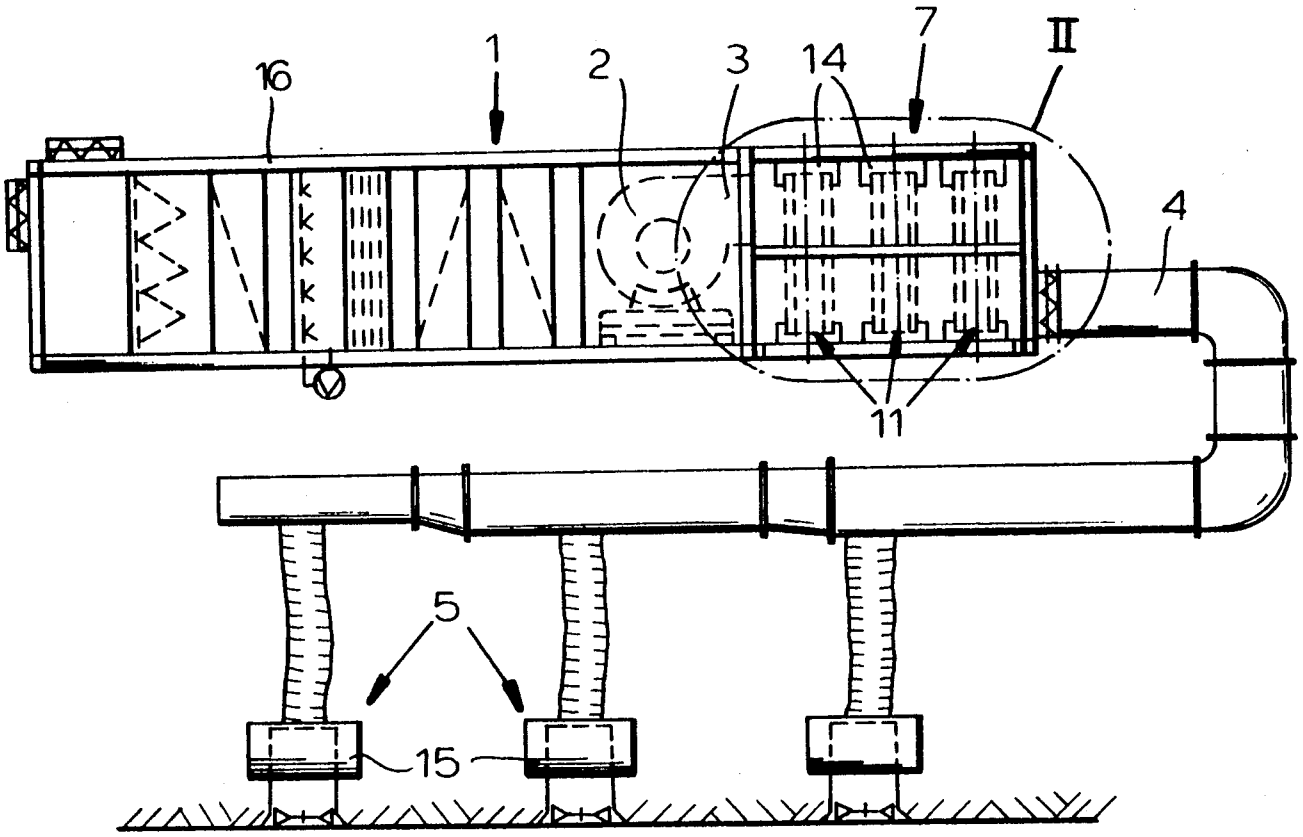
FIG. 1 is a side elevational view in high diagrammatic form illustrating an air conditioning apparatus with a central filtering unit.

FIGS. 1 through 4 are directed to air conditioning systems for use in the human field, i.e. for the conditioning of air to be supplied to an environment in which humans live, work or engage in recreational activities. In particular, the air conditioners of these FIGS. are intended for living and working spaces and basically comprise a central air conditioning unit 1 for the treatment of room air, i.e. air to be admitted to a room constituting the human environment, a blower 2 for displacing the treated room air and located at the central unit 1, at least one duct 3 for delivering the treated air displaced by the blower, and at least one, but preferably a plurality of, outlet passages or ducts 4 with air outlets 5 for delivery of the treated room air to the space or room 6 to be air conditioned.

The unit 1 can be provided with the equipment necessary for conditioning the air which can include means for moisturizing the air, means for removing moisture from the air, means for heating the air or means for cooling the air or a combination of such means or all of such means. Such units or systems are well known in the art and need not be dealt with in detail here.

It suffices to say that the treatment of the air before it reaches the blower 2 can include a prefiltering to remove particulates and other materials from the air.

In the region of the blower 2 and, more specifically, in the flow direction of the treated air downstream of the blower 2, I provide a filter unit 7 which is traversed by the treated room air.

According to the invention, this filter consists of at least a suspended-material filter 8 and at least one sorption filter. The filter unit 7 is simultaneously provided as a sound-damping device and/or a sound-intercepting or blocking device. The terms sound-blocking and sound-intercepting are used interchangeably here to refer to the interposition in the path of soundwaves of a structure which prevents those soundwaves from being propagated past the structure. The term "sound-damping" is used to refer to a structure which is capable of materially attenuating sound propagated through that structure.

Figure 4:
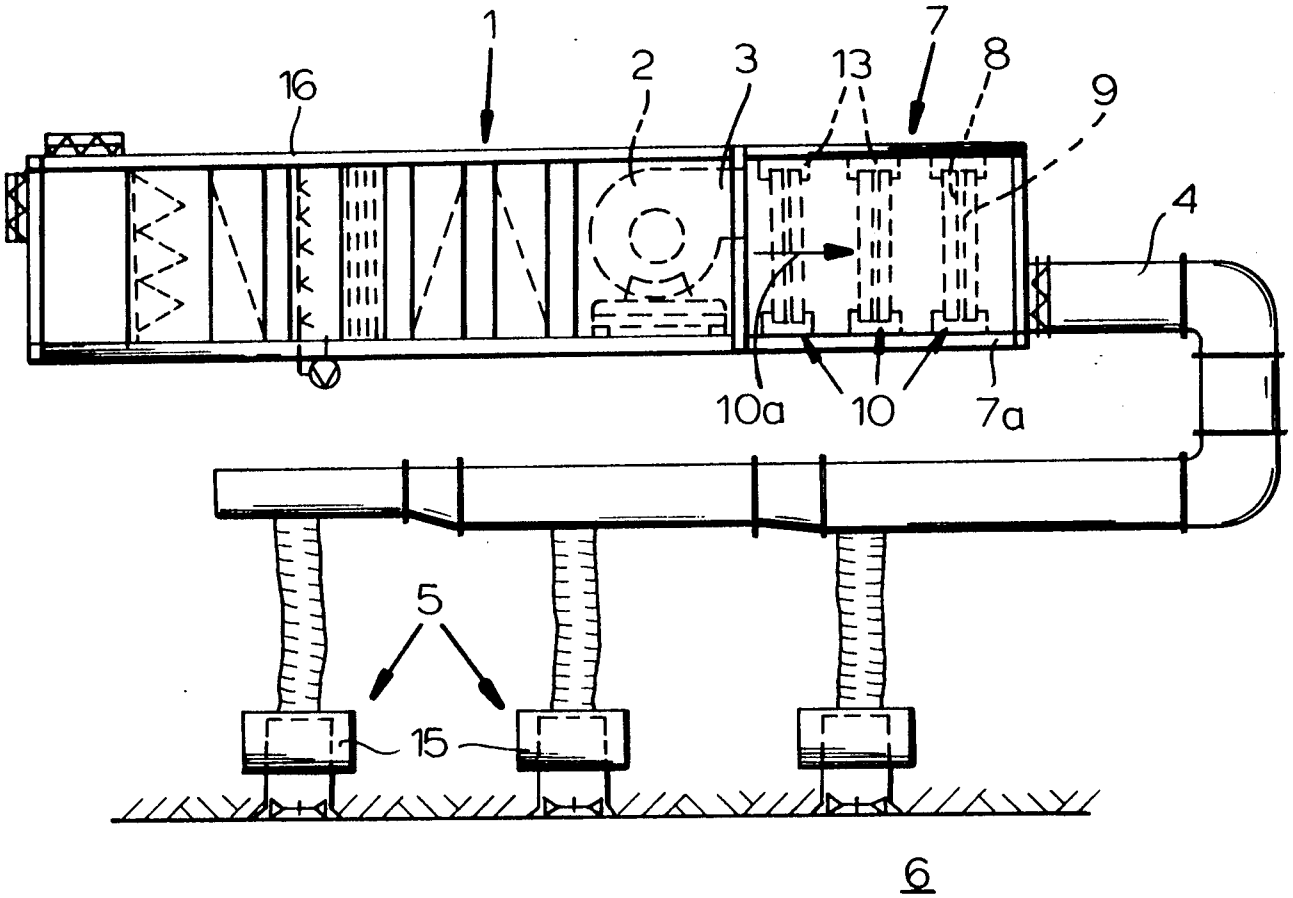
FIG. 4 is a view similar to FIG. 1 illustrating another construction of an air conditioning unit with central filter for a multiplicity of district outlets.

The suspended-filter material filter 8 and the sorption filter 9 to be provided as discreet filter layers located upon one another. In the embodiment of FIG. 4, the filter unit 7 is provided in a duct 7*a* by respective stacks of filter plates 10 extending transversely to a flow direction 10*a* and received in respective holders 13, the plates 10 being formed as suspended material plates 8 and sorption filter plates 9 respectively.

These plates simultaneously function as sound-blocking walls which also have the function of suspended material filter or sorption filter, respectively.

Figure 2:
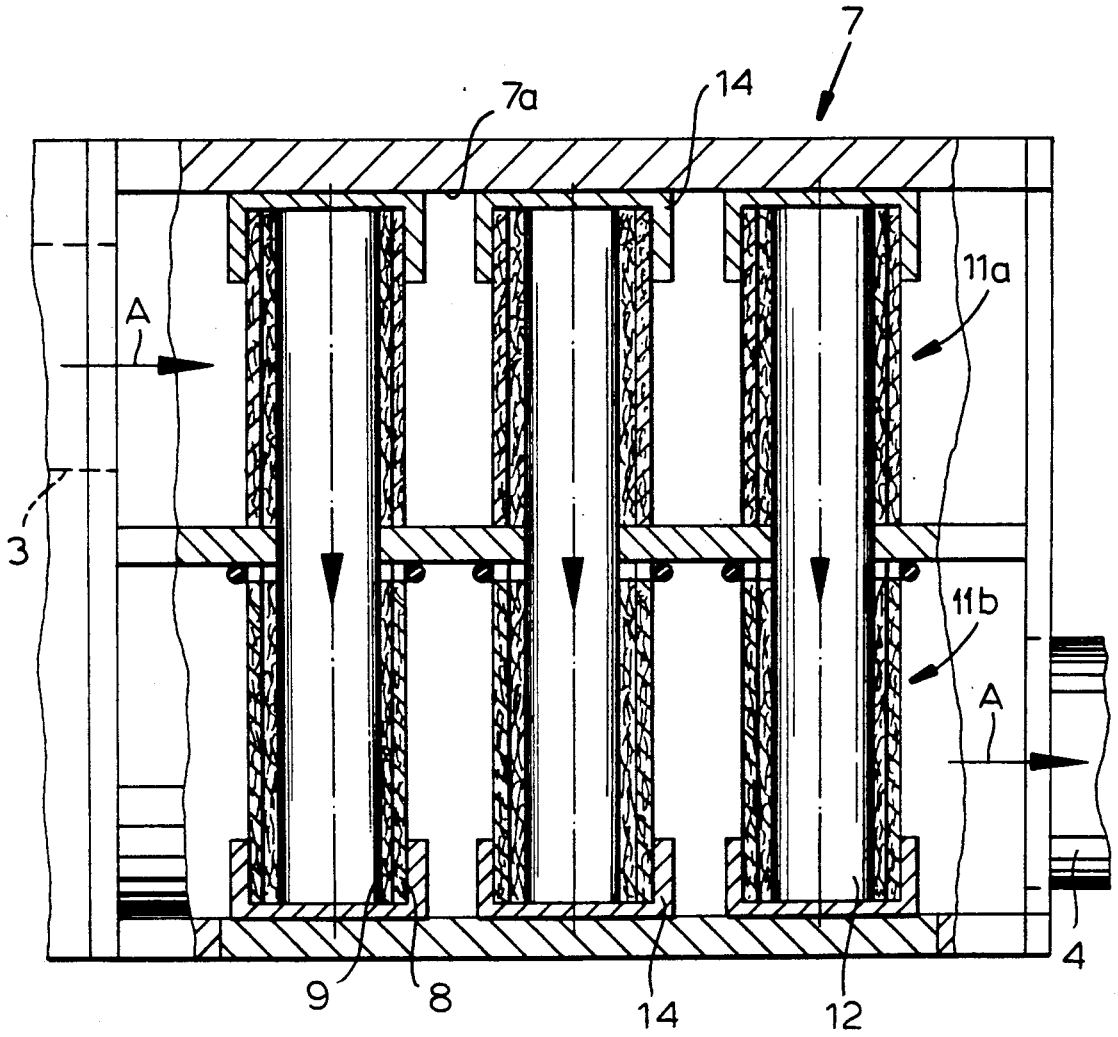
FIG. 2 is a detailed view of the region of FIG. 1 drawn to a larger scale and as seen in cross section.
Figure 3:
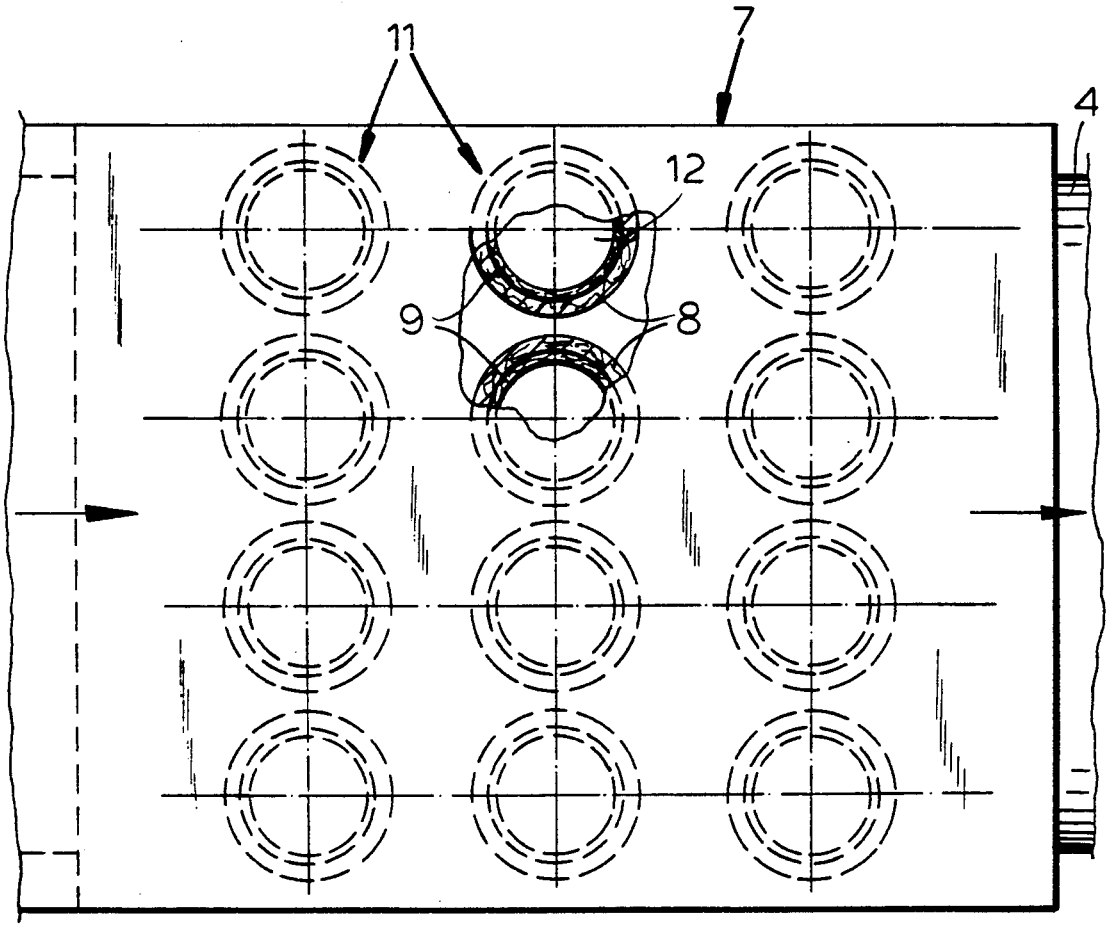
FIG. 3 is a plan view of the detail of FIG. 2.

As can be seen in FIGS. 1 to 3, an alternative construction of the filter unit 7 has a multiplicity of filter cartridges 11 of which at least one and preferably all have suspended material filter layers 8 and sorption filter layers 9 coaxial with one another and the individual filter cartridges 11 formed as sound-adsorbing elements. The multiplicity of filter cartridges 11 can provide the lattice elements of a sound-damping lattice structure baffling sound transmission through the duct 7*a* traversed by the treated air in the direction of arrows A (FIG. 2).

From FIG. 2 it will be apparent that the filter cartridges 11 leave a flow passage 12 free while the shells of the filter cartridges 11 are constituted by the suspended filter material 8 and the sorption filter 9 disposed one upon the other. Each filter cartridge 11 is constituted of two halves 11*a* and 11*b* in which the described layers 8 and 9 have different constructions.

In all cases, the filter plates 10 and filter cartridges 11 form easily replaceable components in the filter unit 7. For example, the filter plates 10 can be constructed as cassette plates which can be slid transversely into cassette guides 13 of the filter unit 7 in an interchangeable manner. The filter cartridge 11, as is expressly apparent from FIG. 2, can be replaceably mounted in cartridge holders 14 of the filter unit 7.

In the latter embodiment it will be apparent that additional filtering devices 15 can be provided along the duct 4 or at the air outlets 5 which are also replaceable and can form sound-damping or sound-blocking elements and serve as final filters before the treated air is discharged into the space 6. The central units 1, the blower 2 and the filter device 7 can be provided in a common housing 16 which itself can be provided with sound-damping or sound blocking means, for example, batts of sound-insulation or the like.

The reference to an air conditioning unit is intended to include units with a ventilation function and units without a venting function. The former may permit fresh air to be supplied to the protected space while the latter merely recirculates air from that space. A proportion of fresh air is most commonly provided.

References here to room air, will not differentiate between external air, recirculated air or mixtures of external air and recirculated air. All are passed through the air conditioning unit and fed to the protected environment.

Suspended material filters are the usual dust filters which are designed to trap particulates in the air and may remove particulates as fine as viral and bacterial particulates as well as, of course, fine and coarse dusts and the like. The sorption filter material is, of course, a material which acts to adsorb or absorb contaminants from the air, in the latter case operating at least in part by chemical reaction with such contaminants. Both suspended-material filter materials and sorption filters are well known in the air filtering art. With respect to the air conditioning unit shown in FIGS. 5 to 9, the central apparatus 1, equipped with the features described for the unit 1 of FIGS. 1 to 4, can serve to treat the room air which is displaced by the blower 2 through the duct 3 for distribution to the space 6.

In this embodiment, a filter unit 7 is provided along the path 21 of the room air and the room air is delivered by the duct 4, forming an outlet duct, to the outlet units 5 at which the room air is supplied to the room or space 6 to be air conditioned.

In this embodiment, at the region of the end of the duct 3, at some distance from the air outlets 5, the filter unit 7 is provided and includes at least one suspension filter 8 and at least one sorption filter 9. This filter unit 7 can be provided in the duct 3 or in the outlet duct 4. The filter unit 7 is simultaneously formed as a sound-damping and/or sound-blocking device.

At the inlet side of the filter unit 7, a volume rate of flow control element 17 is provided, e.g. in the form as a butterfly, and also acts as a sound-blocking and/or sound-damping element. In the embodiment illustrated, the filter unit 7 has ahead of the filters 8 and 9 in the flow direction, a distribution chamber 18 which serves to distribute the flow of air all across the filter cross section. In the flow direction downstream of the filters 8 and 9, a collecting chamber 9 is provided for collecting the flow from the full area of the filters.

These chambers are also provided as sound-blocking and/or sound-damping units and may be lined, for example, with acoustic insulation material.

The flow control element is preferably a flap which can be sound-blocking and/or sound-damping by providing at an acoustically insulated compartment and/or by lining it with sound-absorbing material. It can also be formed by a slider or other motor controlled distributor for the oncoming treated air or can be provided as a motor driven blower wheel.

Figure 7:
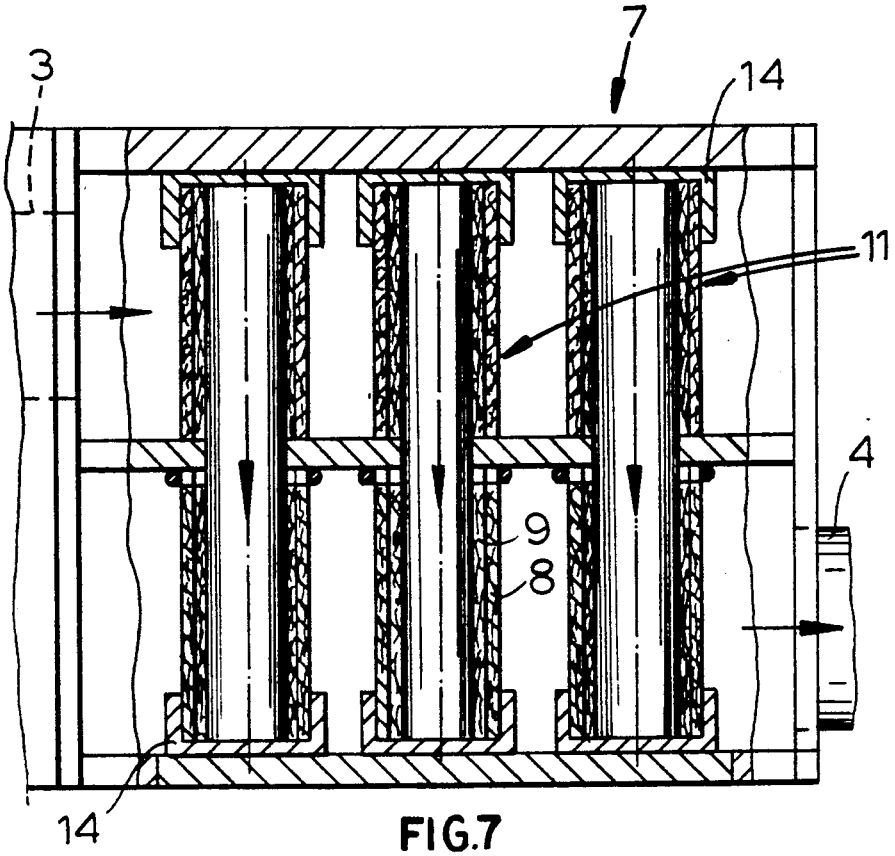
FIG. 7 is another embodiment of the subject matter of FIG. 6 as seen in cross section.
Figure 8:
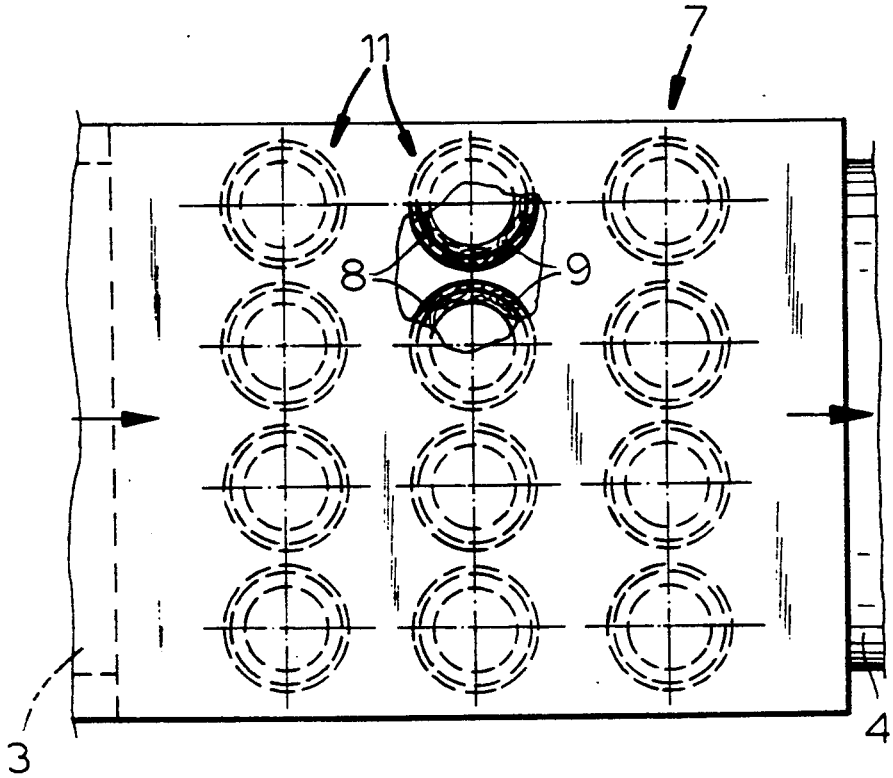
FIG. 8 is a plan view of the filter of FIG. 7.
Figure 9:
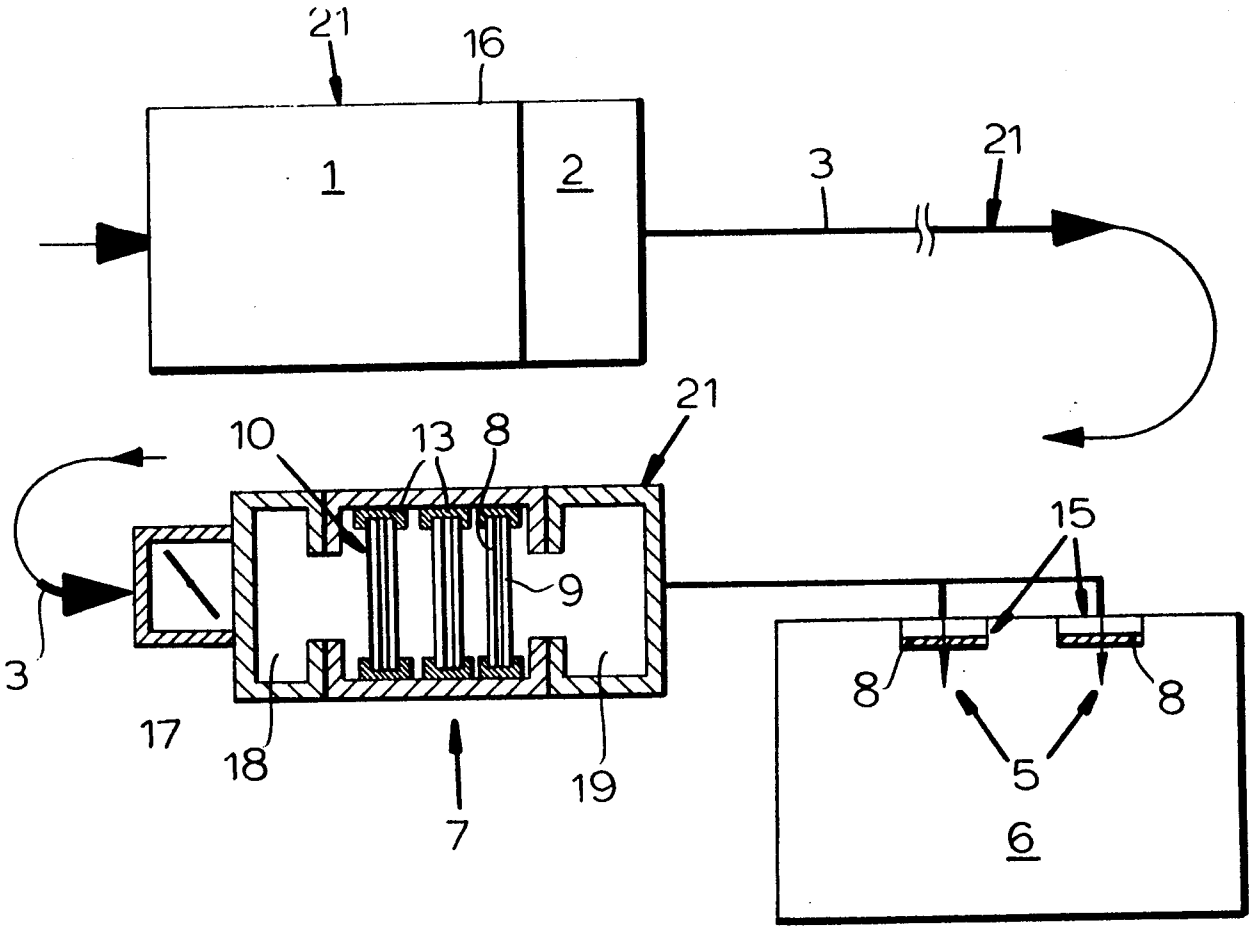
FIG. 9 is a view similar to FIG. 5 but illustrating another embodiment having a room oriented filter.
Figure 10:
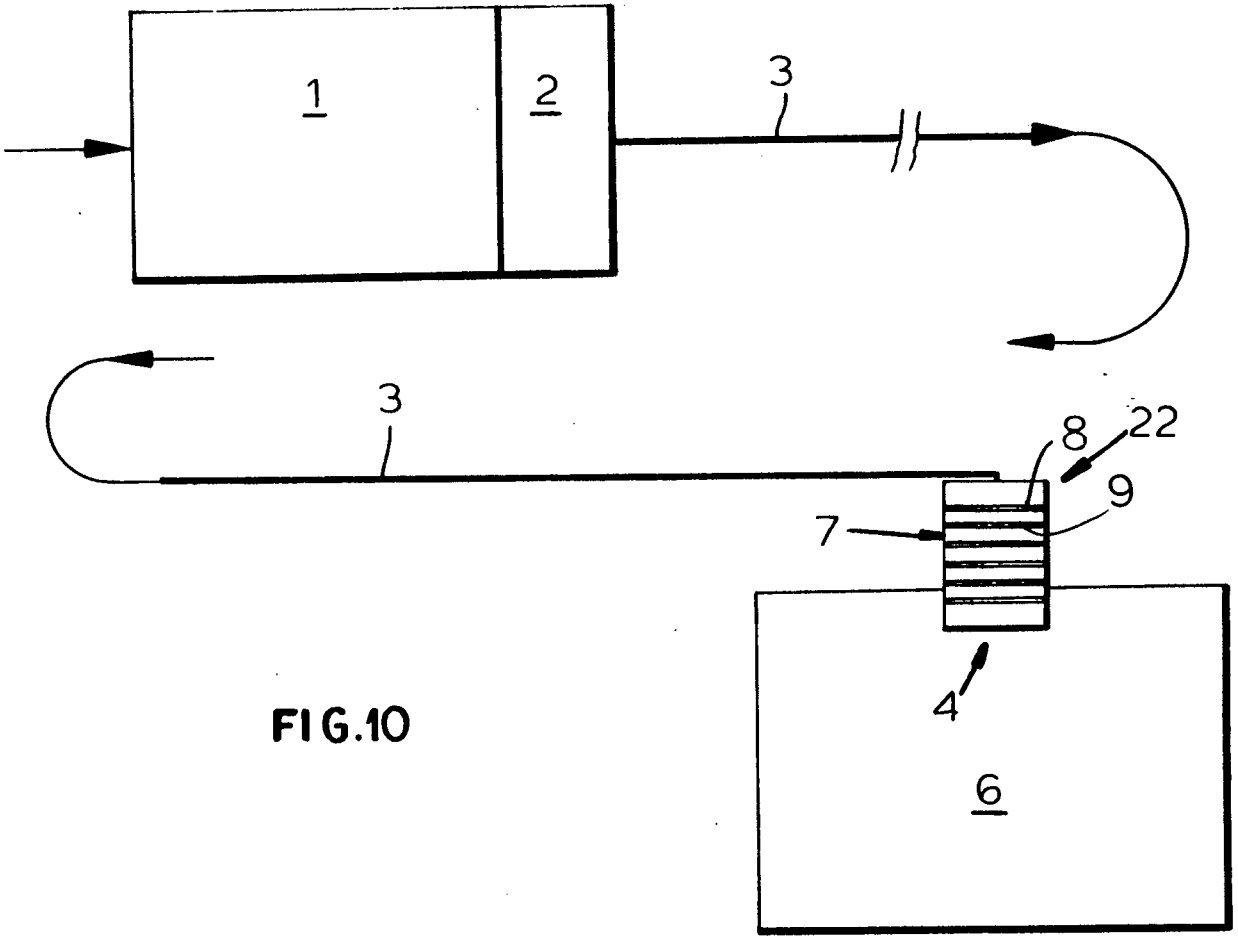
FIG. 10 is a diagram of air conditioning apparatus with a decentralized location of the filter unit.

In the embodiment of FIGS. 5 to 8 as well as in the embodiment of FIG. 9, the filter unit 7 forms a front passage for the treated room air. In the embodiment of FIG. 9, the filter elements are filter plates 10 extending transversely to the flow direction and forming sound-blocking walls with the function of suspension filters 8 and sorption filters 9. In the embodiment of FIGS. 5 to 8, filter cartridges 11 are used.

Figure 5:
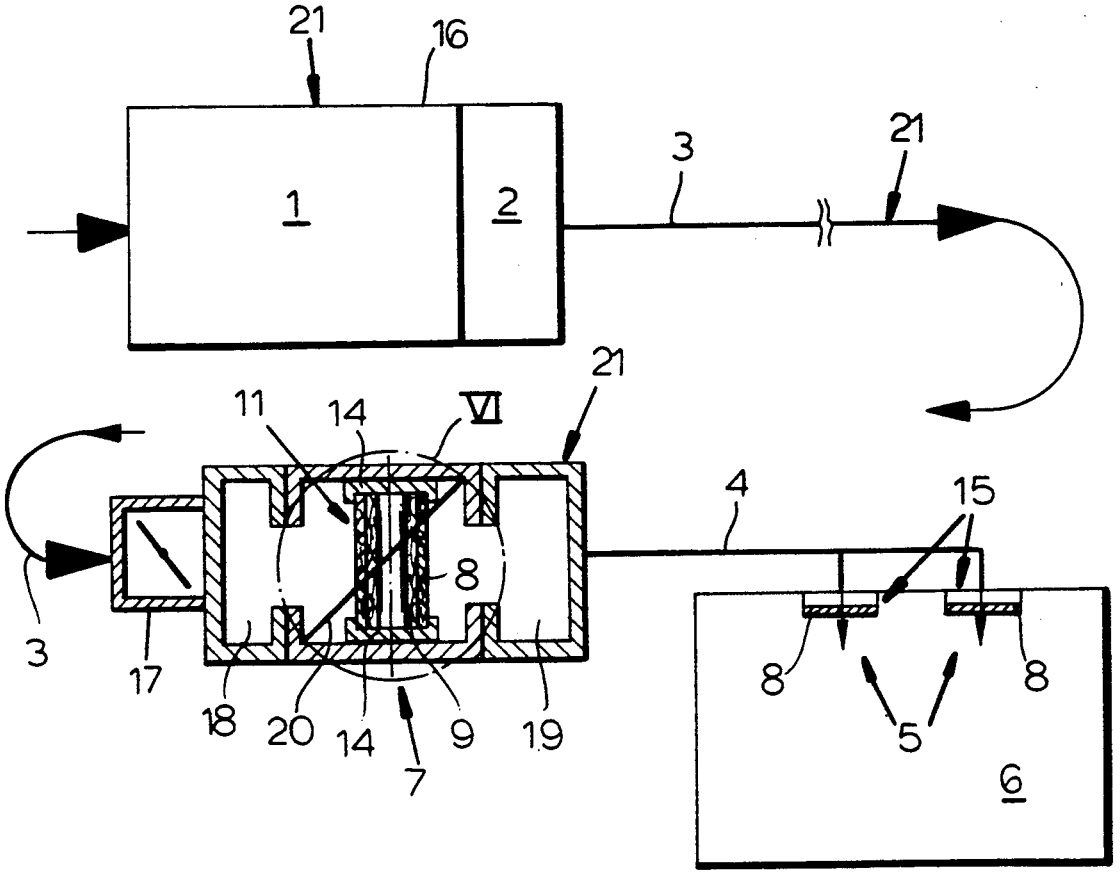
FIG. 5 is a diagrammatic side elevational view, partly broken away and partly in cross section of an air conditioner with a room oriented filter device.
Figure 6:
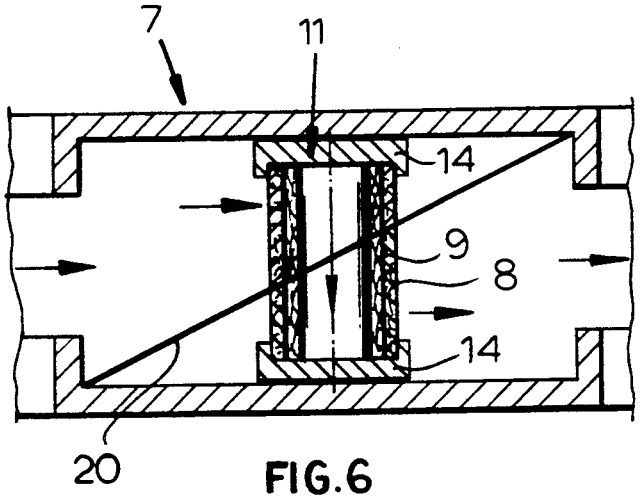
FIG. 6 is a detail view of the portion VI of FIG. 5, drawn to a larger scale.

FIGS. 5 and 6 show an air conditioning unit according to the invention in which the filter unit 7 has filter cartridge 11 at least one of which has at least one suspension filter layer 8 as well as at least one sorption filter 9.

These filter cartridges 11 are provided as sound-absorption elements inserted into an inclined bottomed 20. In FIGS. 7 and 8, a plurality of filter cartridges 11 are shown. The individual filter cartridge 11 here form sound-absorption elements which together define the lattice elements of a sound-damping lattice or grid work.

It should be understood that the filters will be provided, in these embodiments also as easily replaceable components of the filter unit 7. For this purpose, the filter plates 10 forming the sound-blocking walls can be replaceably slid into and removed from cassette guides 13 of the filter unit 7 as cassette plates.

The filter cartridges 11 of the embodiment of FIGS. 5 to 8 are replaceably mounted in the cartridge sockets 14 as previously described.

It has been illustrated in FIGS. 5 to 9 as well that in the vicinity of the air outlets 5 a final filtering device 15 can be provided which can include at least one suspended material filter 8 interchangeably fitted into the housing.

The final filtering units 15 can additionally be provided with sorption filters which also are sound-blocking and/or sound-damping.

The central air conditioning 1 and the blower 2 with its blower blades are arranged in a common housing 16 which is also constructed to be sound-blocking and/or sound-damping This applies as well for the duct 3 and the housing of the filter unit 7. The reference character 21 in the drawing is intended to represent means, devices or elements which render these elements of the pathway for the treated air sound-blocking or sound-damping.

In accordance with the invention, the central air conditioning unit 1 can be equipped in the region of the blower 2 with a filter device composed of at least suspended material, at least one sorption filter and means for rendering these filters sound-damping and sound-blocking as described in connection with the embodiment of FIGS. 1 to 4.

The air conditioning unit shown in FIGS. 10 to 15 also can include the central air conditioning unit 1 for the preparation of treatment of the room air, the blower 2 for the displacement of the treated air in the region of the central unit 1, at least one duct 3 for the treated air displaced by the blower 2, and at least one outlet duct 4 or passage which can have an air feed unit 22 for delivering the room air to the room or space 6 to be air conditioned.

Figure 12:
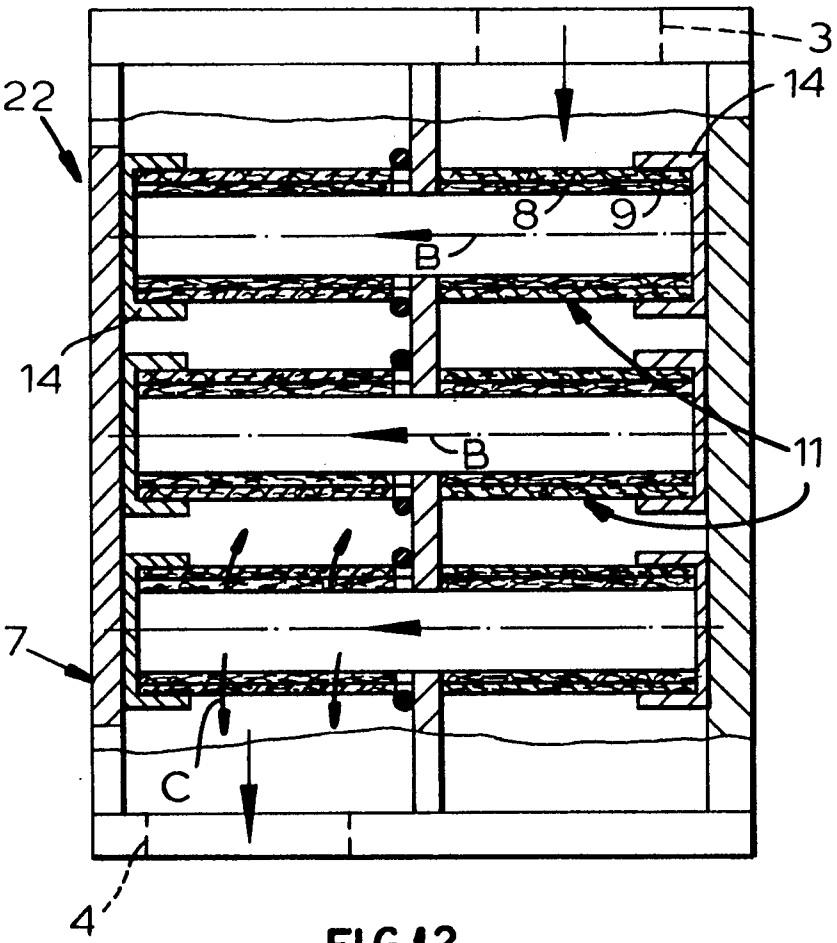
FIG. 12 is a cross sectional view of another embodiment of the filter unit of FIG. 11.
Figure 11:
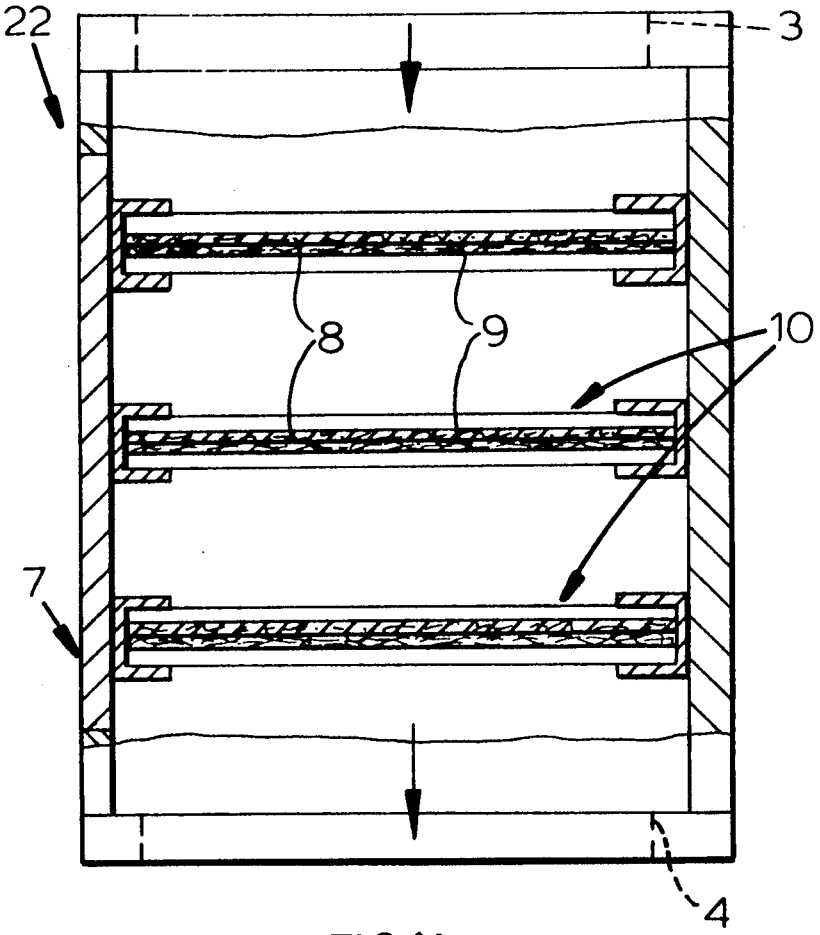
FIG. 11 is a cross sectional view through a filter unit which can be used with the system of FIG. 10 but drawn to a larger scale.

From FIGS. 11 and 12 it will be apparent that in the device 22 a filter arrangement or unit 7 is provided which is transferred by the room air which has been treated. This filter unit 7 has at least one suspended material filter 8 and at least one sorption filter 9. The filter unit 7 simultaneously forms a sound-damping and/or sound-blocking unit in the sense described. The filters 8 and 9 serve as the sound-damping or sound-blocking elements.

FIG. 11 shows that the unit 22 has a flow passage for the treated air within which and transverse to the flow direction, sound-blocking walls are formed by filter plates 10, each of which also has the functions of a suspended material filter 8 or a sorption filter 9.

The embodiment of FIG. 12 is different in that here the air feed transverses a multiplicity of filter cartridges 11, each of which can have at least one suspended material filter 8 and at least one sorption filter 9 in the form of layers. The filter cartridges 11 are replaceably received in cartridge sockets 14 of the filter unit 7 and are traversed in the direction of arrows B by the air, the air escaping through the filter layers as represented by arrows C. The individual filter cartridge 11 are formed as sound absorbing elements and the multiplicity of filter cartridges from the grid elements of a sound-damping grid. It will be understood that the filters 8 and 9 are easily replaceable components admitted to the device 22.

Figure 13:
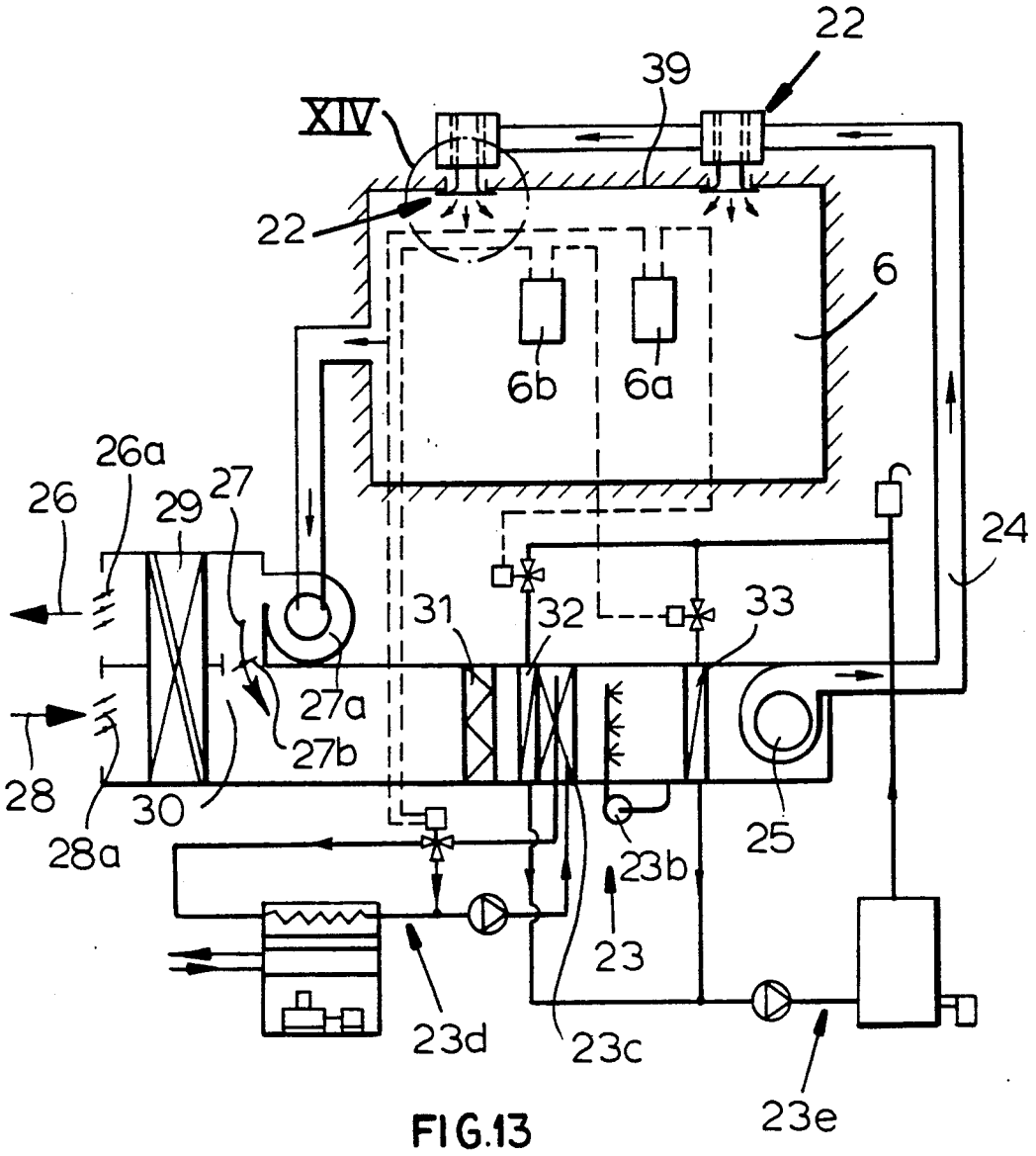
FIG. 13 is a diagram in more detailed form of an air conditioner according to the invention.
Figure 14:
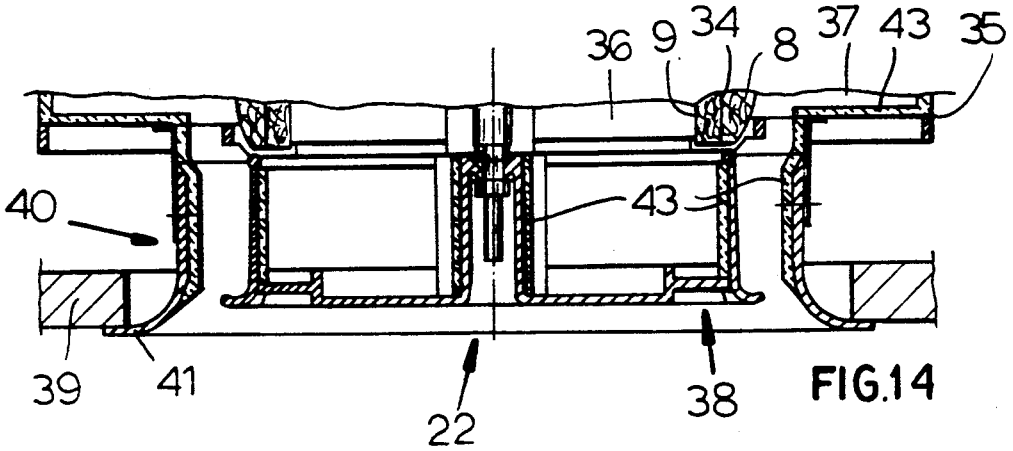
FIG. 14 is a detail in section and drawn to a larger scale of the region XIV of FIG. 13.
Figure 15:
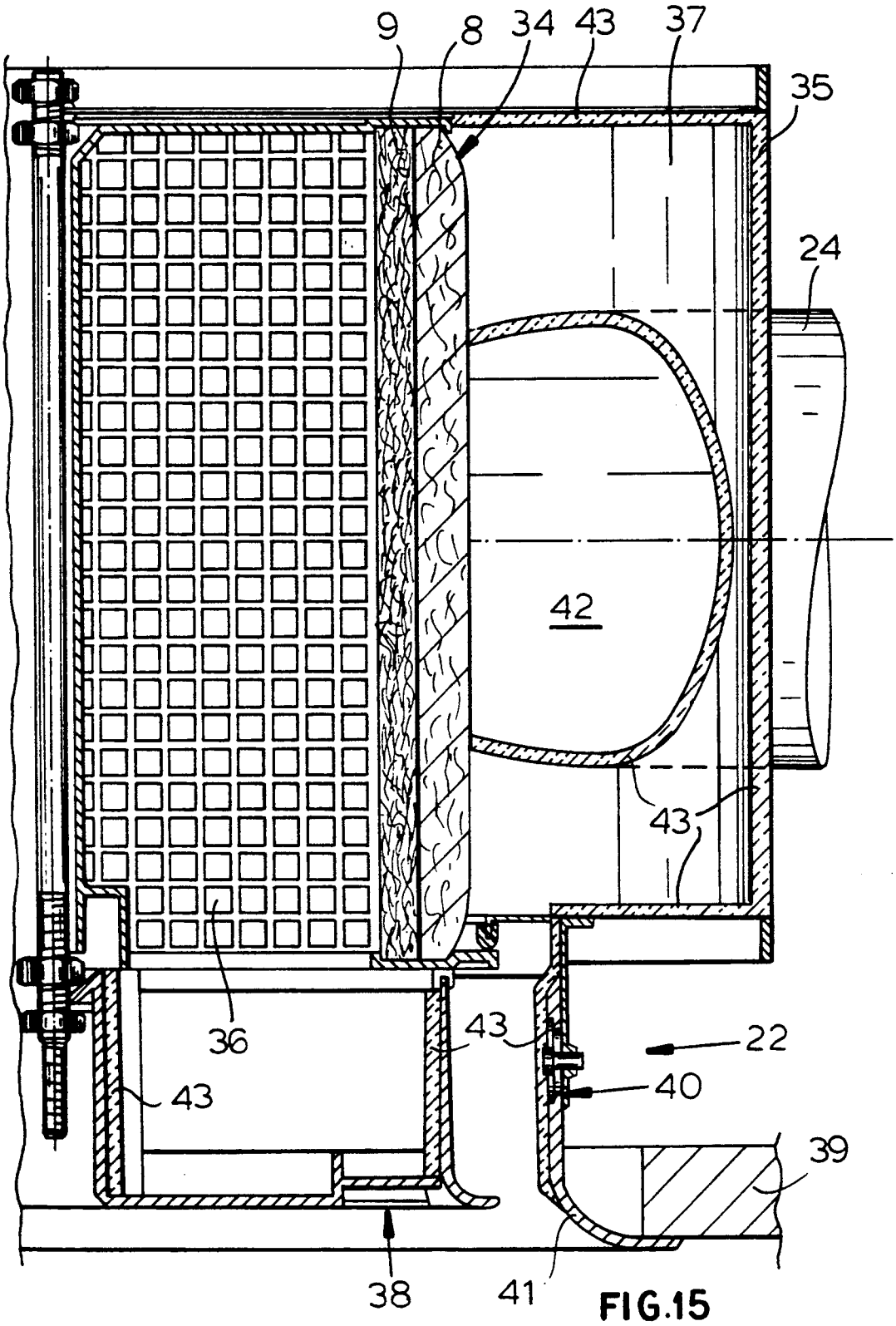
FIG. 15 is a still larger section of a portion of the filter arrangement of the embodiment of FIG. 13.

The air conditioning unit shown in FIGS. 13 to 15 in its passed construction is constructed, apart from its sound-damping or sound-blocking features, much like a standardized or conventional air conditioner.

FIG. 13 shows a room or space 6 to be air conditioned and a central air conditioning unit 23 for treating the air admitted to this space, a feed duct 24 with an air feed unit 22 for admitting the treated air to the room 6 and a feed ventilator or blower 25.

From FIG. 13, moreover, one can see how the air is withdrawn from the space 6 and recycled in accordance with the invention.

The withdrawn air is returned for recycling as represented by the arrow 27 in part and in part is discharged into the atmosphere as shown at 26.

External air 28 is drawn in by the unit via a heat exchanger 29.

It will be apparent from FIGS. 13 to 15, moreover, that the air to be conditioned, which passes through a mixing chamber 30, flows via a filter 31 and a preheater 32 to the treatment unit 23 in which its moisture is adjusted. This moisture adjustment can include, for humidifying the air, water supply unit 23*a* and a pump 23*b* supplying the water, or, if the air is to be dehumidified, a heat exchanger 23*c* which can be supplied with a refrigerant as part of a cooling unit 23*d* for which the heat exchanger serves as a refrigerant evaporator.

An afterheater 33 can be provided along the path of the air to be treated downstream of the refrigerating and/or moisturizing unit.

The heat fluid may also be a refrigerant passing through a recirculating system including a compressor and represented at 23*e* in FIG. 13.

The so treated air is then displaced by the blower 25 to the feed duct 24.

The system is so constructed that the treating unit 23 operates in a predetermined efficiency range and the blower 25, depending upon the preset conditioning parameters of the feed air, in the region ahead of the air discharge units 22 can generate a certain static pressure p. The control systems of the units 23*d* and 23*e* can be selfadjusting accordingly.

As will be apparent from FIGS. 14 and 15, the discharge units 22 each include a replaceable filter unit 34 with a pressure loss $\Delta$ p of at least 50% of the predetermined static pressure p by physical and chemical adsorption. The filter unit 34 also provides, therefore, in addition to the mechanical filtering, a chemisorption alimentation of contaminants.

FIG. 15 shows the construction of the discharge unit 22 and the filter unit 34.

For example, a cylindrical housing 35 can be provided for this unit to receive the replaceable cylindrical filter unit 34 which has a central air outlet 36 opening into the room or space to be air conditioned.

The device housing 35 surrounds the cylindrical filter unit 34 while defining an annular space 37 concentric therewith. The feed duct 24 opens into the annular space 37 and the filter unit 34 surrounds the central outlet 36.

In the embodiment illustrated and in a preferred embodiment of the invention, the feed duct 24 opens into the housing 36 or the annular space 37 tangentially as has been illustrated in FIG. 15.

It will be understood further that the filter unit 34 in general is provided with a multiplicity of layers including acoustic insulation layers so that it functions as a sound-damping structure as well.

Below the central outlet 36 there is provided a twist generating device 38 which applies a twist to the outflowing air or generates a vortex thereof.

The housing 35 is, moreover, fixedly mounted in the ceiling of the space 6 to be air conditioned. Below the housing 35 a ceiling connecting crown 40 is provided which has a flange 41 engaged over the edge of the opening in the ceiling 39.

It will be apparent from FIG. 15 that, upon removal of the crown 40 and the vortex generator 38, the filter 34 can be removed as a unit through the crown 40 axially downwardly and a new filter unit can be inserted upwardly. In this case, the filter unit may be a single replaceable filter cartridge.

The filter unit 34, which has a suspended material filter 8 and a sorption filter 9 as described, also serves, in accordance with the aforedescribed principles as a sound-damping and/or sound-blocking unit. This applies as well for the housing 35 of the air discharge unit 22, the air inlet 42 and the air outlet 36, all of which have the acoustic insulated linings 43.

As described, the conditioning unit is intended to include units with ventilating functions and those without ventilating functions. For example, in the embodiment shown in FIG. 13, air is recirculated from the room 6 by the blower 27*a* as represented by the arrow 27 past a flap valve or butterfly 27*b*, if desired, while fresh air is drawn in as represented by the arrow 28 past a jalously valve arrangement 28*a*. A similar valve arrangement 26*a* may control the amount of air from the chamber 6 which is discharged at 26.

A temperature control 6*a* and a humidity control 6*b* in the space 6 can control valves regulating the circulation of the refrigerant or heating medium in the units 23*d* and 23*e* respectively.

The reference here to room air is intended to designate without differentiation, external air, recirculated air and mixtures of the two which are fed to the room to be air conditioned.

I claim:

1. An air conditioning system for a space adapted to be occupied by people, comprising:

a central air conditioning unit for conditioning room air, said central air conditioning unit having a blower for displacing treated room air;

at least one duct connected to said blower and communicating with said space for delivering the treated room air to said space;

at least one outlet passage communicating with said duct and provided with an air outlet opening into said space for delivering said treated room air thereto; and between said blower and said outlet passage, at least one filter unit traversed by the treated room air, said filter unit comprising at least one suspended material filter and at least one sorption filter for removing contaminants from air, said filters in said filter unit being constructed and arranged to form a sound barrier in which said filters function as sound barrier elements.

2. An air conditioning system for a space adapted to be occupied by people, comprising:

a central air conditioning unit for conditioning room air, said central air conditioning unit having a blower for displacing treated room air;

at least one duct connected to said blower and communicating with said space for delivering the treated room air to said space;

at least one outlet passage communicating with said duct and provided with an air outlet opening into said space for delivering said treated room air thereto; and between said blower and said outlet passage, at least one filter unit traversed by the treated room air, said filter unit comprising at least one suspended material filter and at least one sorption filter for removing contaminants from air, said filters in said filter unit being constructed and arranged to form a sound barrier in which said filters function as sound barrier elements, said filters being formed as air deflectors for deflecting air through flow passages between filter walls so that air traverses said filter walls, then is deflected through said filter passages and emerges through said filter walls whereby said conditioned air undergoes a velocity reduction in traversing said filter walls and an acceleration in said passages.

3. The system defined in claim 2 wherein said filter walls each are composed of a suspended material filter layer and a sorption filter layer.

4. The system defined in claim 2 wherein said filter unit is constructed to provide a minimum pressure drop of 50 Pascal there across.

5. The system defined in claim 2 wherein said filters are formed as plate filters defining flow passages between them.

6. An air conditioning system for a space adapted to be occupied by people, comprising:

a central air conditioning unit for conditioning room air, said central air conditioning unit having a blower for displacing treated room air;

at least one duct connected to said blower and communicating with said space for delivering the treated room air to said space;

at least one outlet passage communicating with said duct and provided with an air outlet opening into said space for delivering said treated room air thereto; and between said blower and said outlet passage, at least one filter unit traversed by the treated room air, said filter unit comprising at least one suspended material filter and at least one sorption filter for removing contaminants from air, said filters in said filter unit being constructed and arranged to form a sound barrier in which said filters function as sound barrier elements, said filters being formed as filter cartridges with cylindrical filter walls and central flow passages therein.

7. An air conditioning system for a space adapted to be occupied by people, comprising:

a central air conditioning unit for conditioning room air, said central air conditioning unit having a blower for displacing treated room air;

at least one duct connected to said blower and communicating with said space for delivering the treated room air to said space;

at least one outlet passage communicating with said duct and provided with an air outlet opening into said space for delivering said treated room air thereto; and between said blower and said outlet passage, at least one filter unit traversed by the treated room air, said filter unit comprising at least one suspended material filter and at least one sorption filter for removing contaminants from air, said filters in said filter unit being constructed and arranged to form a sound barrier in which said filters function as sound barrier elements, said filter unit being located in a region of said central air conditioning unit directly downstream of said blower.

8. The system defined in claim 7 wherein said filter unit is formed with a flow passage for the treating air and said filters are provided as filter plates transverse to said flow passage.

9. The system defined in claim 7 wherein said filters are formed as filter cartridges disposed in spaced apart relation so as to form a sound barrier grid.

10. The system defined in claim 7 wherein further filter units are provided at said air outlet, each having a suspended material filter formed as a sound barrier element.

11. The system defined in claim 2 wherein said filter unit is formed at an end of said duct proximal to said space and adjacent said air outlet.

12. The system defined in claim 11 wherein said filter unit includes at least one flow control element forming a sound barrier element.

13. The system defined in claim 11 wherein said filter unit is provided with a distribution chamber formed with means for attenuating sound therein.

14. The system defined in claim 12 wherein said flow control element is a flap provided with a sound attenuating layer thereon and received in a sound attentuating chamber.

15. The system defined in claim 12 wherein said flow control element is a slider simultaneously forming an air distributor and with a sound attentuating material thereon and received in a sound attentuation housing.

16. The system defined in claim 11, further comprising a final filtering unit provided with at least one suspended material filter forming a sound barrier at said air outlet.

17. An air conditioning system for a space adapted to be occupied by people, comprising:

a central air conditioning unit for conditioning room air, said central air conditioning unit having a blower for displacing treated room air;

a least one duct connected to said blower and communicating with said space for delivering the treated room air to said space;

at least one outlet passage communicating with said duct and provided with an air outlet opening into said space for delivering said treated room air thereto; and between said blower and said outlet passage, at least one filter unit traversed by the treated room air, said filter unit comprising at least one suspended material filter and at least one sorption filter for removing contaminants from air, said filters in said filter unit being constructed and arranged to form a sound barrier in which said filters function as sound barrier elements, said air outlet being formed with a housing provided with said filter unit, said filter unit comprising filter plates each having a respective suspended material filter element and a respective sorption filter element.

18. The system defined in claim 17 wherein said filter unit comprises a plurality of filter cartridges spaced apart to define a sound barrier grid and each of which has a suspended material layer or sorption layer.

19. The system defined in claim 17 wherein said housing is cylindrical and receives a replaceable cylindrical filter unit having a central air outlet and an inlet communicating with said filter and opening into an annular space around said filter, said housing being formed with sound attenuating means.

20. The system defined in claim 19 wherein said air outlet is provided with sound attentuating means thereon.

* * * * *